United States Patent [19]

Yoshioka et al.

[11] Patent Number: 4,479,730

[45] Date of Patent: Oct. 30, 1984

[54] RIBBON CARTRIDGE

[75] Inventors: Satoru Yoshioka; Takumi Namekawa; Iwao Mitsuki, all of Tokyo, Japan

[73] Assignee: Ricoh Company, Ltd., Tokyo, Japan

[21] Appl. No.: 383,062

[22] Filed: May 28, 1982

[30] Foreign Application Priority Data

Jun. 5, 1981 [JP] Japan ..... 56-86725
Jun. 24, 1981 [JP] Japan ..... 56-93475[U]

[51] Int. Cl.[3] ..... B41J 32/00; B41J 35/04
[52] U.S. Cl. ..... 400/208; 400/249
[58] Field of Search ..... 400/195–196.1, 400/208, 248, 249, 234, 243, 239, 235.1

[56] References Cited

U.S. PATENT DOCUMENTS

| | | | |
|---|---|---|---|
| 2,174,351 | 9/1939 | Neidich | 400/239 |
| 3,731,781 | 5/1973 | Candill et al. | 400/249 |
| 3,819,027 | 6/1974 | Landgraf | 400/243 |
| 3,977,512 | 8/1976 | Teagarden et al. | 400/248 |
| 4,146,338 | 3/1979 | Hedstrom | 400/249 |
| 4,272,202 | 6/1981 | Schroeder et al. | 400/235.1 |
| 4,307,969 | 12/1981 | Daughters | 400/243 |
| 4,352,575 | 10/1982 | Shore | 400/208 |
| 4,364,678 | 12/1982 | Ogan | 400/234 |

FOREIGN PATENT DOCUMENTS

| | | | |
|---|---|---|---|
| 2512259 | 9/1976 | Fed. Rep. of Germany | 400/239 |
| 2951610 | 7/1981 | Fed. Rep. of Germany | 400/196.1 |
| 56-8286 | 1/1981 | Japan | 400/249 |

OTHER PUBLICATIONS

Lenney, "*Ribbon Drag Wire*" IBM Technical Disclosure Bulletin, vol. 18, No. 4, p. 1093, 9/75.
Mikes "*Ribbon Advance Mechanism*" Xerox Disclosure Journal, vol. 2, No. 4, p. 49, 8/77.

*Primary Examiner*—William Pieprz
*Attorney, Agent, or Firm*—David G. Alexander

[57] ABSTRACT

A ribbon cartridge has openings through its lower casing in order to selectively receive an electric conduction type ribbon end sensor or a photoelectric type ribbon end sensor on a printer. Ribbon housed in the ribbon cartridge extends across one of the openings which is separated from the other by a webbing. Where the sensor is of the electric conduction type, the webbing ensures the location of its electrodes to the back of the ribbon which carries a conductive member on its back. The ribbon is provided with, in addition to a transparent tape section at its tail end, a thin piece which is connected by means of an adhesive to the ribbon adjacent to the tail end. An upper casing is formed with a window to facilitate visual checks on a remaining length of the ribbon. An area of the inner surface of the lower casing which corresponds to the window is painted in a color different from that of the ribbon, thereby promoting quicker and more accurate checks on the remaining length.

17 Claims, 17 Drawing Figures

RIBBON CARTRIDGE

BACKGROUND OF THE INVENTION

The present invention relates to a ribbon cartridge for use with a typewriter, a printer or like printing apparatus.

A ribbon cartridge for such applications comprises a lower casing and an upper casing which is coupled over the lower casing, though not limited to this design. Ribbon is stored in the lower casing wound on a supply reel. Generally, such ribbons are classified into a fabric type in which a fabric ribbon bears ink, a one time or disposable type in which a film layer and an ink layer are formed one upon the other and, each time a character is printed out, ink in the corresponding area is removed, and a multi-strike type which allows its each area to be hammered a plurality of times. It is a usual practice to feed the ribbon from the supply reel to the outside of the ribbon cartridge through an outlet formed through the lower casing, introduce it again into the ribbon cartridge through an inlet also formed through the lower casing at a predetermined spacing from the outlet, and wind it on a take-up reel by way of a feed mechanism installed in the lower casing. Where the ribbon cartridge is mounted to an operative position in a printing apparatus, a serrated roller forming part of a feed mechanism is brought into driven connection with a motor of the apparatus. Driven by the motor, the serrated roller or feed roller cooperates with another serrated roller such that the ribbon is progressively removed from the supply reel and fed to the take-up reel through between the coactive rollers. Data are printed out on a sheet of paper carried on a platen by selecting desired ones of numerous type members carried on a type wheel or like type element and hammering the type members in succession onto the paper through a part of the ribbon which spans the outlet and inlet of the lower casing.

In a printing apparatus which uses this type of ribbon cartridge and prints out data using a length of ribbon stretched between the outlet and the inlet of the lower casing, it is generally desired that a proper magnitude of tension be imparted to the ribbon while the latter is fed in order to promote exact data reproduction. Ribbon cartridges are usually provided with a special tension mechanism which puts the ribbon under tension in the path of movement from the supply reel to the take-up reel. However, the intricate tension mechanism which is independent of the rest of the arrangement in the ribbon cartridge results disproportionate time and labor necessary for assembling the whole ribbon cartridge while increasing the number of component parts which has critical influence on cost.

It is a first object of the present invention to provide a ribbon cartridge which needs a minimum number of component parts, and has a structure easy to assemble and quite simple.

Meanwhile, the ribbon stretched between the outlet and inlet is pressed against and largedly redirected by those edge portions of the lower casing where the outlet and inlet are defined. The pressure under which the ribbon is urged against the edges is considerable in order that the ribbon may be stretched without any slack between the outlet and inlet. However, though the edges concerned are rounded, their friction with the ribbon is of a magnitude which is even objectionable for smooth feed of the ribbon.

It is a second object of the present invention to provide a ribbon cartridge which ensures smooth feed of a ribbon throughout a predetermined path.

In case where the ribbon cartridge houses the one time ribbon or the multi-strike ribbon, the operator has to frequently check an amount of the ribbon remaining on the supply reel; otherwise, the ribbon may possibly run out during a printing operation to cause interruption. With this in view, a ribbon end sensor mechanism is usually installed in a printing apparatus while a ribbon cartridge is formed with a slot through its lower casing which extends across ribbon thereinside. As a tail end portion of the ribbon moves past the slot, it is sensed by the sensor mechanism to interrupt a printing operation.

There is known a ribbon end sensor of electric conduction type having electrodes which will penetrate through the slot into contact with the back of ribbon within a ribbon cartridge when the latter is mounted on the printing apparatus. Ribbon applicable to this type of sensor carries a conductive member on its back adjacent to the tail end so that the conductive member sets up electric conduction between the electrodes as it moves past the slot entrained by the ribbon. Another known ribbon end sensor is of the photoelectric type which comprises a light emitting element and a light receiving element. When a ribbon cartridge is loaded in the printing apparatus, the light emitting and light receiving elements will project into the ribbon cartridge through the slot of the lower casing to face the ribbon from opposite sides. Ribbon applicable to this type of sensor has a tail end portion constituted by a light transmitting member such that the light transmitting member passes light from the light emitting element therethrough to the light receiving element as it moves past the slot.

If the electrodes of the electric conduction type ribbon end sensor are located to the front face of the ribbon which does not carry the conductive member, they will fail to contact the conductive member on the back face of the ribbon and, therefore, to sense the tail end of the ribbon. Accordingly, the slot in the lower casing must be dimensioned small enough to prevent the electrodes from being positioned to the front of the ribbon. In contrast, the photoelectric type ribbon end sensor needs a relatively large slot in order to accommodate the light emitting and light receiving members at opposite sides of the ribbon and ensure a sufficient space for the transmission of light from the light emitting element to the light receiving element. A compromise between these conflicting requirements has been selecting a ribbon cartridge each time which meets a specific type of ribbon end sensor mechanism employed.

It is a third object of the present invention to provide a ribbon cartridge which is applicable to both the electric conduction type and photoelectric type ribbon end sensor mechanisms.

Another known implement for checking a remaining length of ribbon is a window for confirmation by sight which is formed through the upper casing of the ribbon cartridge. This still involves a drawback that, since both the ribbon cartridge and ribbon bear the same color such as black and are hardly distinguishable from each other, the operator cannot confirm a length to go without interrupting the printing operation each time and checking through the window by sight.

It is a fourth object of the present invention to provide a ribbon cartridge which permits a remaining length of ribbon to be seen instantaneously and easily while a ribbon cartridge is in use.

It is another object of the present invention to provide a generally improved ribbon cartridge.

SUMMARY OF THE INVENTION

In order to achieve the first object, a ribbon cartridge in accordance with the present invention includes a resilient clip member which is located above a supply of ribbon wound on a supply reel and is attached to an upper portion of the supply reel. The clip member extends beyond the maximum diameter of the ribbon and hooks a part of ribbon which is being fed toward a take-up reel, thereby applying a tension to the ribbon. Thus, a suitable back tension can be imparted to the ribbon merely by mounting the clip member to the upper portion of the supply reel and then hooking the ribbon to the clip.

In order to achieve the second object, the ribbon cartridge of the present invention includes a pulley or roller for guiding the ribbon at each of an outlet and an inlet which the ribbon spans.

In order to achieve the third object, the ribbon cartridge of the present invention has openings through its lower casing in order to receive into the cartridge an electric conduction type ribbon end sensor or a photoelectric type ribbon end sensor on a printer as desired. Ribbon housed in the ribbon cartridge extends across the openings which are separated from each other by a webbing. Where the sensor is of the electric type, the webbing ensures the location of its electrodes at the back of the ribbon which carries a conductive member on its back. The ribbon is provided with, in addition to a transparent tape section at its tail end, a thin piece which is connected by means of an adhesive to the ribbon adjacent to the tail end.

In order to achieve the fourth object, the ribbon cartridge of the present invention has an upper casing which is formed with a window extending a predetermined distance radially toward the center of the supply of ribbon on the supply reel. The inner surface of the lower casing is locally painted in a color different from that of the ribbon in register with the window, thereby facilitating visual discrimination of a remaining amount of ribbon on the supply reel.

DESCRIPTION OF THE PREFERRED EMBODIMENTS

While the ribbon cartridge of the present invention is susceptible of numerous physical embodiments, depending upon the environment and requirements of use, substantial numbers of the herein shown and described embodiments have been made, tested and used, and all have performed in an eminently satisfactory manner.

Figure 1:
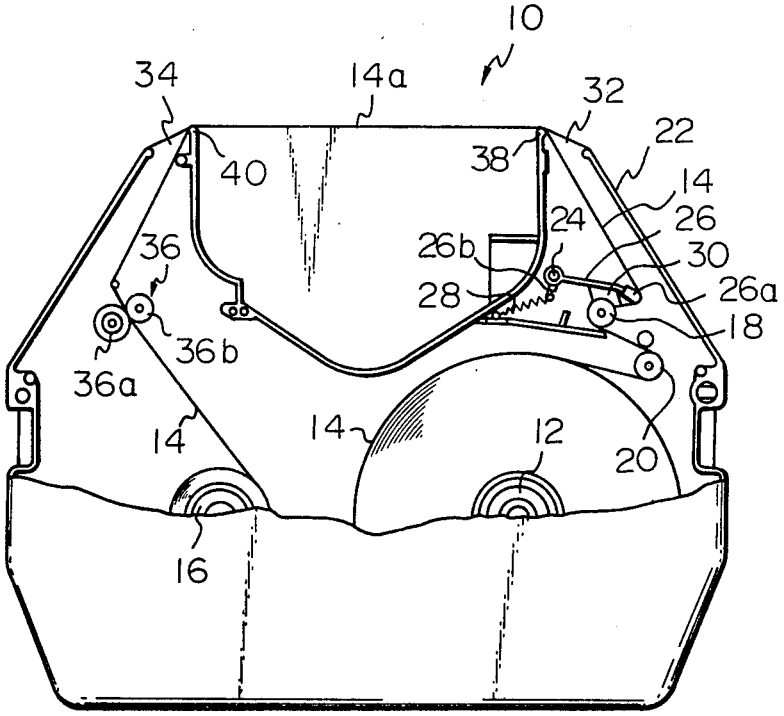
Fig. 1 PRIOR ART
FIG. 1 is a schematic plan view of an internal arrangement of a prior art ribbon cartridge.

Referring to FIG. 1 of the drawings, a prior art ribbon cartridge is shown and generally designated by the reference numeral 10. The ribbon cartridge 10 includes a supply reel 12 containing a supply of ribbon would thereon and a take-up reel 16 to which ribbon is guided from the supply reel 12 by a pair of rollers 18 and 20. A pin 24 extends from a lower casing 22 of the ribbon cartridge 10 adjacent to the rollers 18 and 20 while a rocker member in the form of a lever arm 26 is movably coupled over the pin 24. A spring 28 is under tension between a dog **26*b* of the lever arm 26 and the lower casing 22 thereby constantly urging the lever arm 26 toward the supply reel 12. Ribbon 14 is engaged by the free end 26*a* of the spring-biased lever arm 26 whereby it is imparted with a back tension. A block of sponge 30 intervenes between the roller 18 and the lever arm 26. Outside the ribbon cartridge 10, the ribbon 14 spans an outlet 32 and an inlet 34 which are formed through the lower casing 22 at a predetermined spacing. From the inlet 34, the ribbon 14 is advanced to a feed mechanism 36 which passes the ribbon 14 to the take-up reel 16. The feed mechanism 36 comprises a serrated roller or feed roller 36*a* and another serrated roller 36*b* coactive with the feed roller 36*a***.

Where the ribbon cartridge 10 is mounted to an operative position in a printer, the feed roller **36*a* is brought into driven connection with a motor installed in the printer. Driven by the motor, the feed roller 36*a* cooperates with the roller 36*b* so that the ribbon 14 is progressively unwound from the supply reel 12 and fed to the take-up reel 16 through between the rollers 36*a* and 36*b*. Data are printed out on a sheet of paper by selecting desired ones of numerous type members carried on a type wheel or like type element and hammering the type members in succession onto the paper through a part 14*a* of the ribbon 14 which spans the outlet 32 and inlet 34. At the outlet 32 and inlet 34, the ribbon 14 is greatly redirected by and strongly pressed against respective edges 38 and 40 of the lower casing 22. The strong pressure is required in order that the ribbon 14 may stretch itself from the outlet 32 to the inlet 34** without any slack as illustrated.

This type of prior art ribbon cartridge suffers from various drawbacks as previously discussed. Though the edges 38 and 40 are rounded, their friction with the ribbon 14 is too intense to promote smooth feed of the ribbon 14. The intricate tension mechanism 24, 26, 28, 30 contributes to an increase in time and labor for assembling the whole ribbon cartridge 10 and that in the number of component parts which increases the cost.

Figure 2:
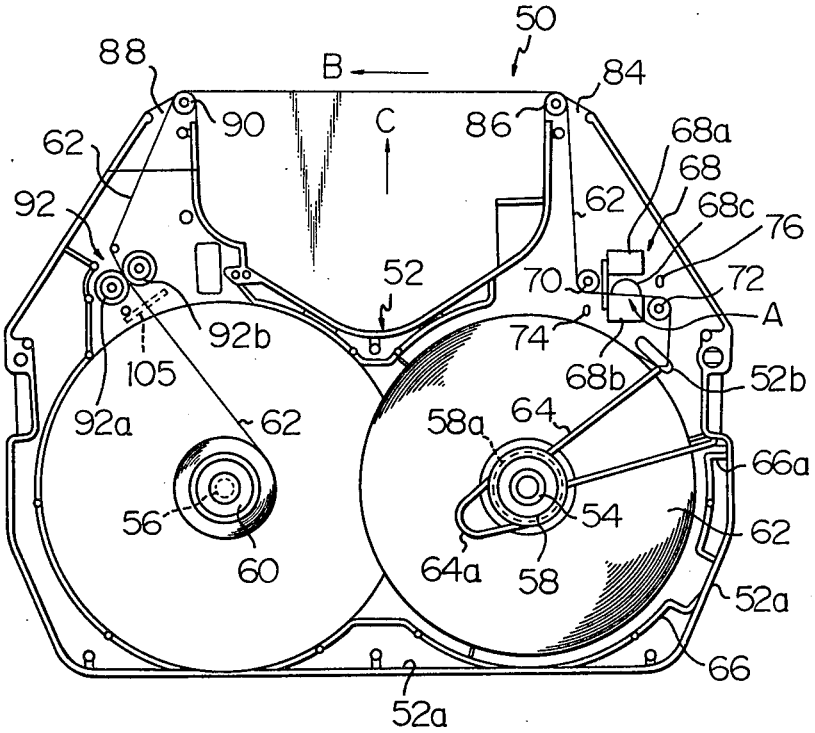
FIG. 2 is a plan view of a ribbon cartridge embodying the present invention with an upper case thereof removed.

Referring to FIG. 2, a ribbon cartridge embodying the present invention is generally designated by the reference numeral 50. The ribbon cartridge 50 comprises a lower casing 52 and an upper casing 54 (see FIG. 3) though the latter is absent in FIG. 2. Hubs 54 and 56 extend upwardly from the lower casing 52 to carry a supply reel 58 and a take-up reel 60 rotatably thereon, respectively. A supply of ribbon 62 is wound on the supply reel 58.

Figure 4:
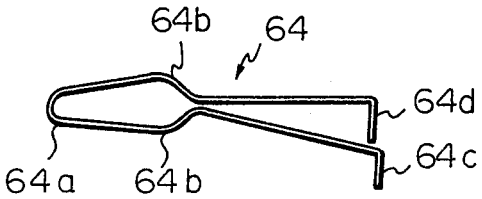
FIG. 4 is a perspective view of a resilient clip member installed in the ribbon cartridge of the present invention.

A resilient clip member 64 is located above the ribbon 62 on the supply reel 58. As shown in FIGS. 2 and 4, the clip member 64 comprises a single wire of metal which is bent to hold an upper portion of the supply reel 58 between its two legs. In detail, the clip member 64 is shaped to have a generally U-shaped base or bend **64*a*, two legs 64*b* extending from the bend 64*a* locally curved toward each other and received in an annular recess 58*a* formed in an upper part of the supply reel 58 so as to resiliently nip the reel upper part therebetween, and angled extensions 64*c* and 64*d* each extending downwardly from the corresponding leg 64*b* toward the lower casing 52. Whereas one 64*c* of the angled extensions is retained by one end 66*a* of a stiffening rib 66 which extends along a side wall 52*a* of the lower casing 52, the other 64*d* is positioned in a slot 52*b* formed through the bottom of the lower casing 52. Ribbon 62 extending from the supply reel 58 to the take-up reel 60 is movably hooked to the extension 64*d* of the clip 64 and thereby placed under tension which urges it toward the supply reel 58**.

The clip 64 is attached to the ribbon cartridge 50 by opening its legs **64*b* away from each other while holding the bend 64*a* and then coupling the legs 64*b* in the annular recess 58*a* in the supply reel 58 from diametrically opposite sides. Since the entire clip 64 has a relatively large length along the diameter of the ribbon 62 on the supply reel 58, the legs 64*b*** can be opened with ease to facilitate the attachment.

Figure 5:
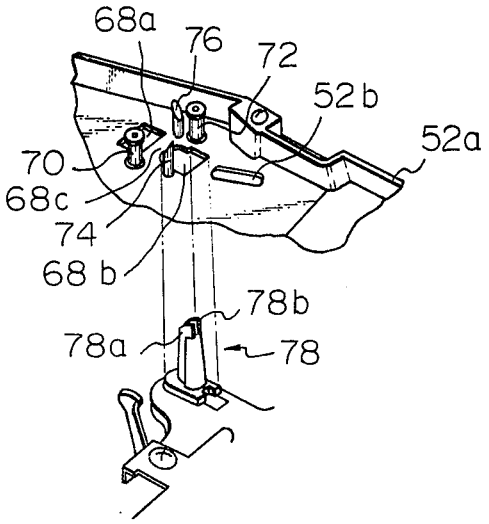
FIGS. 5 and 6 are perspective views of two different examples of ribbon end sensing mechanisms relevant to the present invention.
Figure 6:
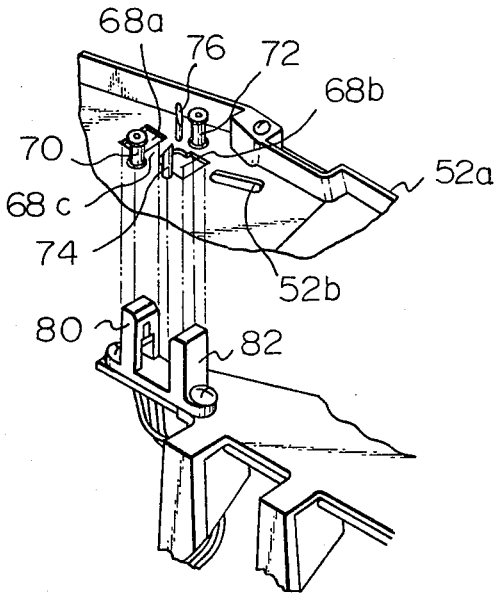
Figure 7:
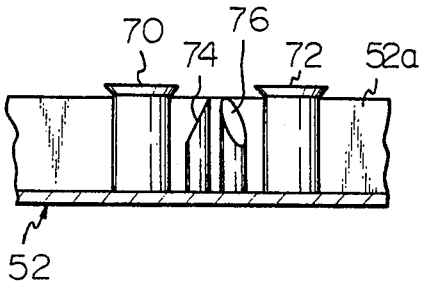
FIG. 7 is a schematic fragmentary view of the lower casing.

Adjacent to the slot **52*b*, the lower casing 52 is formed with openings 68, openings 68*a* and 68*b*, so that a tail end portion of the ribbon 62 can be sensed by a ribbon end sensing mechanism installed in the printer. Different types of known ribbon end sensors are illustrated in FIGS. 5 and 6 and will be discussed below. A webbing 68*c* intervenes between the openings 68*a* and 68*b*. A pair of pulleys or rollers 70 and 72 and a pair of guide posts 74 and 76 are positioned in opposing relation at both sides of the openings 68, guiding the ribbon 62 along the center of the total length of the openings 68 inclusive of the webbing 68*c*. As seen in FIG. 7, the guide posts 74 and 76 are formed with obliquely truncated tops which face the adjacent rollers 70 and 72. The truncated configuration of each guide post will facilitate insertion of the ribbon 62 between it and the coactive adjacent roller from above the lower casing 52**.

The ribbon end sensor shown in FIG. 5 comprises electrodes generally denoted by the reference numeral 78 and made up of two electrodes **78*a* and 78*b* arranged side by side. When the ribbon cartridge 50 is loaded in the printer, the electrodes 78 will protrude into the ribbon cartridge 50 through one 68*b* of the openings 68 to be engaged by the back face of the ribbon 62. The ribbon 62, on the other hand, carries a conductive member on its back adjacent the tail end so that the conductive member can set up electric conduction between the electrodes 78 when it moves past the opening 68*b***, as will be described in detail.

The other ribbon end sensor shown in FIG. 6 is in the form of a photosensor which comprises a light emitting element 80 and a light receiving element 82. When the ribbon cartridge 50 is loaded in the printer, the coactive elements 80 and 82 will penetrate individually through the openings **68*a* and 68*b* into the ribbon cartridge 50 and face each other at opposite sides of the ribbon 62. A portion of the ribbon 62 adjacent to its tail end is constituted by a light transmitting member so that, upon passage of the light transmitting member above the opening 68*b*, light emitted from the element 80 can pass therethrough to reach the element 82 to detect the end of the ribbon 62**.

The webbing **68*c* between the openings 68*a* and 68*b* well serves in connection with the ribbon end sensor of FIG. 5 in ensuring the location of the sensor at the back of the ribbon 62 in the cartridge. Should the electrodes 78 be positioned at the front of the ribbon 62 which carries the conductive member on its back, they would fail to contact the conductive member and, therefore, to detect the end of the ribbon 62**.

Figure 8:
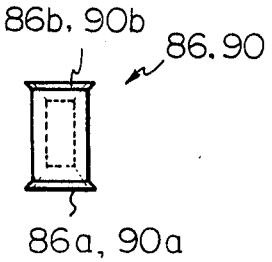
FIG. 8 is a side elevation of a pulley or roller in accordance with the present invention.

The ribbon 62 moved past the opening **68*b* is advanced to a pulley or roller 86 at an outlet 84 and thereby guided to a pulley or roller 90 at an inlet 88, which faces the outlet 84 at a predetermined spacing. Thus, the ribbon 62 is fed by the rollers 86 and 90 without any direct or strong contact with the side wall 52*a* of the lower casing 52. This imparts a minimum of friction to the ribbon 62 thereby promoting smooth feed of the ribbon. As shown in FIG. 8, each roller 86 (90) has flanges 86*a* (90*a*) and 86*b* (90*b*) at its opposite ends which are tapered toward each other in order to effectively prevent the ribbon 62 from becoming offset upwardly or downwardly or being collected irregularly on the take-up reel 60**.

The ribbon 52 is advanced from the roller 90 to a feed mechanism 92 which comprises a serrated roller or feed roller **92*a* and a coactive serrated roller 92*b*. The feed roller 92*a* moves the ribbon 62 to the take-up reel 60 in cooperation with the roller 92*b*. When the ribbon cartridge 50 is mounted on the printer, the feed roller 92*a*** will come into driven connection with the motor of the printer.

Figure 3:
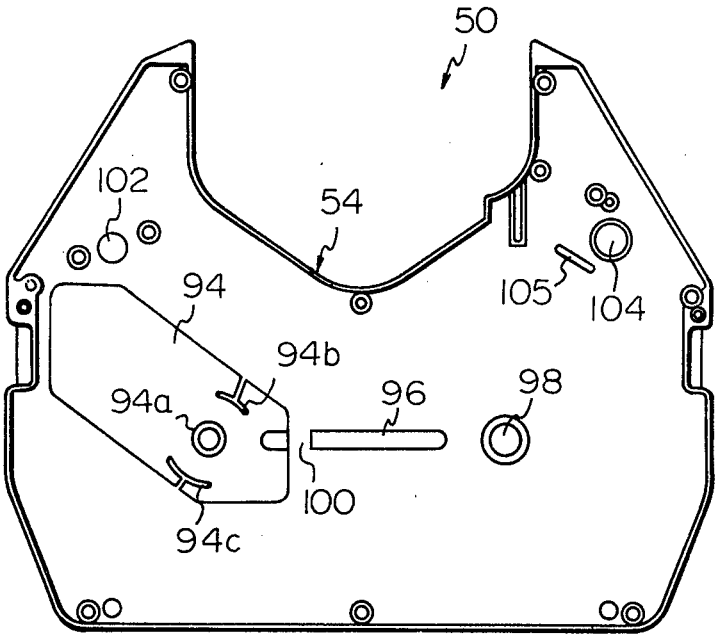
FIG. 3 is a plan view of the inner surface of the upper casing.

Referring to FIG. 3, the upper casing 54 of the ribbon cartridge 50 is formed on its internal surface with a recess 94 for accommodating the resilient clip 64 therein upon engagement of the upper casing 54 with the lower casing 52. The upper casing 54 has within the recess 94 a cylindrical projection **94*a* engagable with the supply reel 58 and a pair of arcuate ribs 94*b* and 94*c* concentric with the projection 94*a*. The ribs 94*b* and 94*c* are spaced from the projection 94*a* by a distance calibrated to prevent them from engaging with the supply spool 58 to prevent its rotation when the upper casing 54 is attached to the lower casing 52. When an impact force is applied to the ribbon cartridge 50, the ribs 94*b* and 94*c* adjacent to the projection 94*a* keeps the ribbon 62 on the supply spool 58 from entering the recess 94. The upper casing 54 is also formed with a relatively long window 96 for facilitating visual checks on a remaining amount of ribbon as will be described in detail with reference to FIG. 13. A hole 98 is formed through the upper casing 54 to receive an upper portion of the take-up reel 60 at a position opposite to the projection 94***a* with respect to the window 96. A stiffening rib 100 is provided to the window 96 in a position where a wall defining the recess 94 is located. The upper casing 54 is formed with a hole 102 for passing the electrodes 78 of the ribbon end sensor therethrough, and a hole 104 for passing an upper portion of the feed roller 92*a* of the feed mechanism 92.

The upper casing 54 is further formed with a rib 105 in the vicinity of the hole 104 for the feed roller 92*a*. As indicated by a phantom line in FIG. 2, the rib 105 will be located between the feed mechanism 92 and the take-up reel 60 and rather adjacent to the feed mechanism 92 while extending across the ribbon 62, when the upper and lower casings are coupled together Thus, the rib 105 ensures stable take-up of the ribbon 62 by the take-up reel 60 preventing the ribbon 62 fed by the feed mechanism 92 from being largely dislocated due to flexure or the like.

Figure 9:
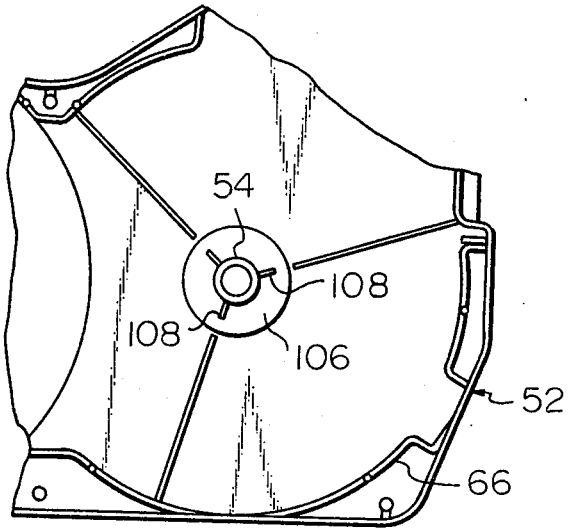
FIG. 9 is a fragmentary view of the inner surface of the lower casing.

As shown in FIG. 9, a circular recess 106 is formed around the hub 54 for the supply reel 58 on the lower casing 52. Generally, the ribbon 62 is wound on the supply reel 58 by coupling a special ring (not shown) over the supply reel 58, connecting the ribbon 62 to the ring by adhesive and then winding the ribbon 62 around the supply reel 58. In this instance, the adhesive tends to bulge itself out to form undulation around the ring. When the ribbon 62 is attached to the supply reel 58, the recess 106 around the hub 54 serves to accommodate the possible undulation so that the ribbon 62 can be fully registered with the bottom of the lower casing 52. A plurality of ribs 108 extend radially outwardly from the hub 54 to cause the ribbon 58 into line-to-line contact therewith while the latter is fed, thereby ensuring stable ribbon feed with the ribbon 62 held under suitable friction.

Figure 10:
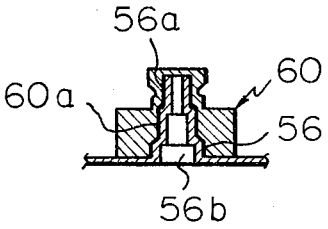
FIG. 10 is a sectional side elevation of a hub and a take-up reel coupled over the hub.
Figure 11:
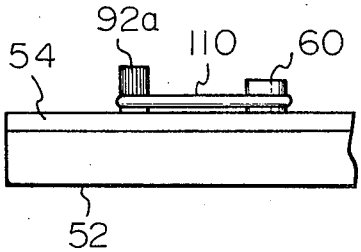
FIG. 11 is a schematic view of a feed roller and the take-up reel operatively connected together by a rubber band.

Referring to FIG. 10, the hub 56 for the take-up reel 60 is formed with an upward extension 56*a* over which a bore 60*a* formed in the take-up reel 60 to a complementary shape is coupled. A bore 56*b* extends throughout the hub 56. The extension 56*a* of the hub 56 of the ribbon cartridge 50 can be inserted into a bore 56*b* of a similar hub of another ribbon cartridge 50. With this configuration, a number of such ribbon cartridges can be conveniently batched together with at an assembling or packaging stage. As viewed in FIG. 11, the upper portions of the feed roller 92*a* and take-up reel 60 projecting upwardly from the upper casing 54 are interlocked by a rubber band 110 so that rotating the feed roller 92*a* will cause the take-up reel 60 into rotation to remove a possible slack from the ribbon 62. Since the hub 56 extends upwardly as far as a position adjacent to the top of the bore 60*a* of the take-up reel 60, that is, up to the level of the rubber band 110, it will be seen that the take-up reel 60 is prevented from being dislocated or inclined relative to the hub 56 though pulled by the rubber band 110 toward the feed roller 92*a*.

Figure 12:
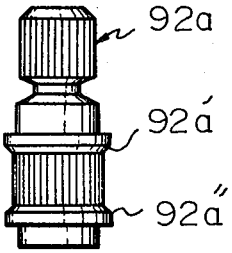
FIG. 12 is a side elevation of the feed roller.

As shown in FIG. 12, the feed roller 92*a* is provided with flanges 92*a*' and 92*a*'' for guiding the ribbon 62. Preferably, the flanges 92*a*' and 92*a*'' are tapered toward each other so that the ribbon 62 is constantly located midway between them.

Figure 13:
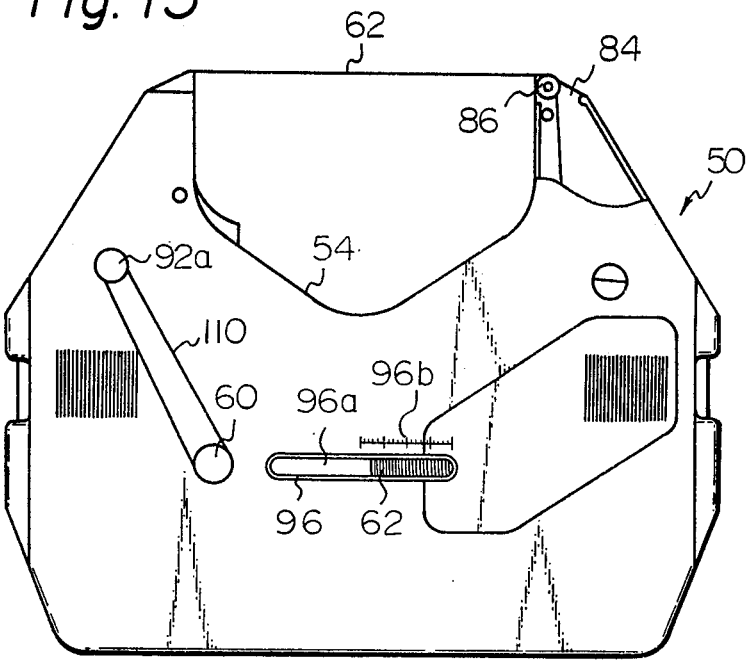
FIG. 13 is a plan view of the ribbon cartridge, particularly indicating a window for checking a remaining amount of ribbon on the supply reel.

Referring to FIG. 13, the window 96 in the upper casing 54 (see FIG. 3) is located between the supply reel 58 and the take-up reel 60 as viewed from the front. A limited area 96*a* of the inner surface of the lower casing 52 which registers with the window 96 may be painted in a color contrastive to the color of the ribbon 62; where the ribbon 62 is black as is usually the case, the area 96*a* of the lower casing may be painted white. The gist is to promote the ease of visual discrimination of the ribbon 62 from the inner surface 96*a* of the lower casing.

Graduations 96*b* are formed on the upper casing 54 adjacent to the window 96 and nearer to the supply reel 58 than to the take-up reel 60. The graduations 96*b* provide exponential indication of remaining amount of the ribbon 62 in terms of time or number of pages. The ribbon 62 wound on the supply reel 58 resembles a disc in shape whose diameter acceleratedly decreases as the ribbon 62 is consumed. The operator can thus see an accurate time period or number of pages to go with the same ribbon cartridge 50. If desired, the graduations 96*b* may be carried on the inner surface 96*a* of the lower casing 52 which is visible through the window 96.

Another possible measure for the visual identification of the ribbon 62 may be a strip of paper (not shown) colored differently from the ribbon 62, e.g. white. In this case, the paper strip may be surrounded by a frame formed on the inner surface 96*a* of the lower casing.

Thus, a remaining amount of ribbon can be seen accurately and instantaneously through the window 96 with the aid of the contrastive colors of the ribbon 62 and inner surface of the lower casing. This avoids unexpected interruption of a printing operation due to the run-out of the ribbon 62. The graduations 96*b* further enhances the ease and accuracy of the checks on the remaining ribbon and, thereby, improves the efficiency of the whole printing operation.

Hereinafter will be described some preferred examples of the ribbon 62 which are applicable to both the different types of ribbon end sensors shown in FIGS. 5 and 6.

Figure 14:
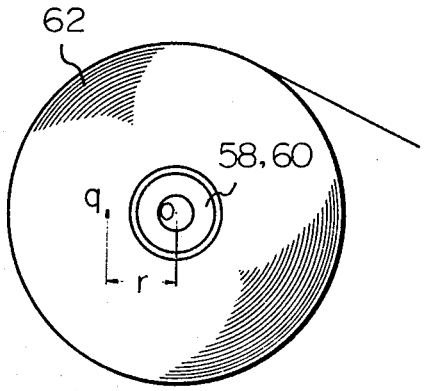
FIG. 14 is a plan view of a ribbon wound into a pancake form.

The ribbon 62 is usually would on the supply reel 58 or the take-up reel 60 to the shape of a disc as indicated in FIG. 14. As already stated with reference to FIG. 2, the ribbon 62 is stored in the ribbon cartridge 50 to be rotatable about the hub 54 or 56. The ribbon cartridge 50 is loaded in a printing apparatus which is equipped with the photosensor 80, 82 or the electrodes 78 as viewed in FIGS. 5 and 6 for sensing the tail end of the ribbon 62. Positioning of the ribbon cartridge 50 on the printer is such that, as previously mentioned, the electrodes 78 are passed through the opening 68*b* or the photosensor elements 80 and 82 through the openings 68*a* and 68*b*, respectively. In a sensing position A indicated in FIG. 2, the electrodes 78 or the photosensor 80, 82 contacts or faces the ribbon 62.

Figure 15:
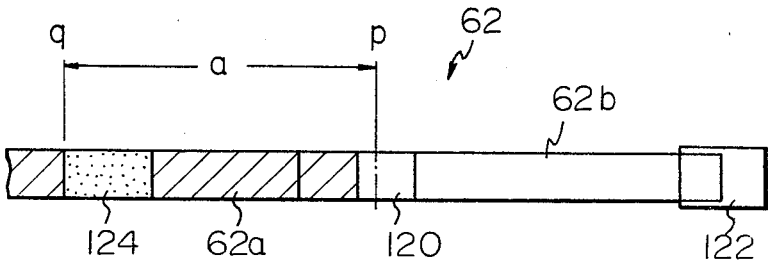
FIG. 15 is an enlarged fragmentary view of the back surface of the ribbon of FIG. 14 adjacent to the tail end.
Figure 16:
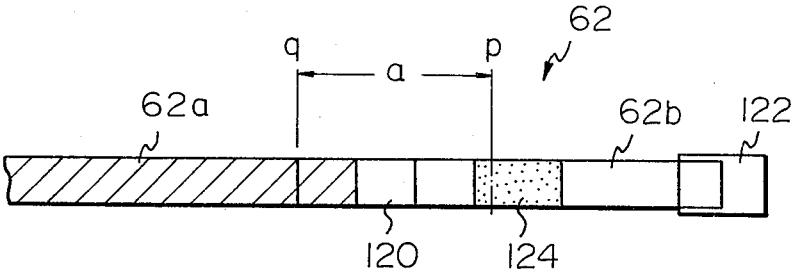
FIGS. 16 and 17 are views similar to FIG. 16 but showing other examples of the ribbon in accordance with the present invention.
Figure 17:
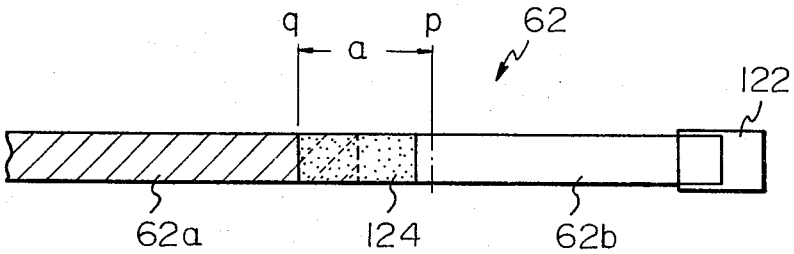

FIGS. 15–17 illustrate various examples of the tail end configuration of the ribbon 62. In FIG. 15, the ribbon 62 includes an inked portion 62*a* and a non-inked portion 62*b* which is constituted by a transparent tape following and connected to the inked portion 62*a* by a transparent adhesive tape 120 at its back. The tail end of the transparent non-inked portion 62*b* is rigidly connected to a core 122 by suitable means. A highly conductive metal foil or like thin piece is bonded to the back of the inked portion 62*a* adjacent to the tail end.

Suppose that the ribbon 62 shown in FIG. 15 is stored in the ribbon cartridge 50 as shown in FIG. 2 and the ribbon cartridge 50 is loaded in a printer having the photosensor 80, 82. Then, as the ribbon 62 is fed as indicated by an arrow B in FIG. 2 until the transparent non-inked portion 62*b* arrives at the photosensor 80, 82, light is transmitted through the portion 62*b* to indicate that the ribbon 62 has run out. Where the ribbon cartridge 50 is placed in a printer with the electrodes 78*a* and 78*b*, the conductive thin piece 124 on the ribbon 62 will set up electric conduction between the electrodes 78*a* and 78*b* to provide the same indication when it reaches the electrodes 78*a* and 78*b*.

As shown in FIG. 16, the conductive thin piece 124 may be adhered to the back of the transparent noninked portion 62*b* instead of the inked portion 62*a*. Furthermore, as indicated in FIG. 17, the conductive thin piece 124 may be adhered to the backs of the adjacent ends of the inked portion 62*a* and non-inked portion 62*b* to replace the adhesive tape 120.

The thin piece 124 may be constituted by a highly reflective foil instead of the conductive metal foil, if desired. Such a thin piece 124 finds its application to a printer having a photosensor which is sensitive to reflection of light.

Now, in the examples shown, the thin piece 124 is bonded to the ribbon by an adhesive or, where the adhesive tape 120 is used as in FIG. 15 or 16, it is also bonded using an adhesive. However, should the adhesive flow out from around the thin piece 124 or the adhesive tape 120, it would be transferred to an inked surface which is radially one round outside in the condition shown in FIG. 14. Printing out data with the inked portion 62*a* to which the adhesive has been transferred would deteriorate the quality of reproduced data. It is therefore preferable that the end of the ribbon 62 be detected to stop a printing operation before the inked portion 62*a*, possibly with the adhesive, reaches a print position C indicated in FIG. 2. For this purpose, there is required a relation $$a+2\pi r<l \qquad (1)$$

where l denotes the length from the sensing position A to the printing position C shown in FIG. 2, a the length from a sensing position p to the leading edge q of a member which is applied with an adhesive at the foremost end, i.e. thin piece 124 or adhesive tape 120, as shown in FIGS. 15–17, and r the radial distance from a position O corresponding to the center of the disc-shaped ribbon to the leading edge q mentioned. It will be seen that, if without the addition of "$2\pi r$" to "2", the adhesive would oozed out from the leading edge q and stick to an inked surface radially one round outside the edge q in the wound ribbon 62 shown in FIG. 14.

The equation (1) may be rewritten as $$a<l-2\pi r$$

Supposing that l is 80 mm and 2r is 18 mm, $$a<23.5 \text{ (mm)}$$

Since the length l cannot be so large in an ordinary ribbon cartridge, it is advantageous to adhere the thin piece 124 to the adjacent ends of the inked portion 62*a* and non-inked portion 62*b*.

It will be seen from the above that the ribbon 62 having a transparent tape at its tail end and a thin conductive or reflective piece is applicable to both a printer furnished with a ribbon end sensor sensitive to transmitted light and a printer furnished with a ribbon end sensor sensitive to electric conduction or reflection of light. This saves time and labor heretofore required for selecting a ribbon to meet a specific type of printer.

Various modifications will become possible for those skilled in the art after receiving the teachings of the present disclosure without departing from the scope thereof.

What is claimed is:

1. A ribbon cartridge comprising:

a casing formed with a ribbon outlet and a ribbon inlet;

a supply reel;

a supply of ribbon wound on the supply reel;

a take-up reel;

ribbon means provided adjacent to the take-up reel for feeding ribbon along a predetermined path from the supply reel onto the take-up reel;

tension supply means for applying a tension to the ribbon;

guide means located adjacent to the ribbon outlet and the ribbon inlet for guiding the ribbon which spans the ribbon outlet and the ribbon inlet outside the casing;

ribbon end detector mounting means provided in the casing such that the ribbon advancing through the predetermined path between the supply reel and the ribbon outlet traverses the ribbon end detector mounting means;

the tension supply means comprising a resilient clip member which has a generally U-shaped base portion, a pair of legs extending from opposite ends of the base portion beyond the maximum diameter of the ribbon on the supply reel and locally curved toward each other to fit in an annular recess formed in an upper portion of the supply reel, and parallel bends extending downwardly from the respective legs, one of the downward bends being fixed in place by a rigid portion of the casing while the other being held in a defined position in an elongate opening formed through the casing, said other downward bend urging the ribbon in such a direction that the ribbon is placed under tension, the U-shaped base portion being radially spaced from the upper portion of the supply reel in the opposite direction to the legs;

the ribbon end detector mounting means comprising a detecting opening formed in the casing for receiving a detecting portion of a ribbon end detector; and second guide means provided adjacent to the opening for guiding the ribbon such that the ribbon is fed across the opening along the predetermined path;

the second guide means comprising a first roller for receiving the ribbon from the supply reel, and a second roller for receiving the ribbon from the first roller to guide the ribbon to the ribbon outlet;

the second guide means further comprising a first guide post opposite to the first roller and a second guide post opposite to the second roller, the ribbon being inserted into a gap between the first guide post and the first roller and a gap between the second guide post and the second roller;

each of the first and second guide posts being formed with an obliquely truncated upper end which faces the corresponding roller.

2. A ribbon cartridge as claimed in claim 1, in which the guide means comprises a third roller mounted on a stationary portion of the casing adjacent to the ribbon outlet and a fourth roller mounted on a stationary portion of the casing adjacent to the ribbon inlet.

3. A ribbon cartridge as claimed in claim 2, in which each of the rollers is formed with flanges at opposite ends which are tapered toward each other.

4. A ribbon cartridge as claimed in claim 1, the ribbon feed means comprises a feed roller having a driven connection with a drive source when the ribbon cartridge is mounted on a printing apparatus and a roller coacting with the feed roller in feeding the ribbon along the predetermined path.

5. A ribbon cartridge as claimed in claim 1, in which the detection opening comprises two perforations which are separated by a webbing which is a part of the casing.

6. A ribbon cartridge as claimed in claim 5, in which the ribbon end detector comprises two detecting electrodes for detecting a conductive ribbon end indicating member provided adjacent to the end of the ribbon, the electrodes being inserted into one of the perforations when the ribbon cartridge is mounted on the ribbon end detector.

7. A ribbon cartridge as claimed in claim 5 in which the ribbon end detector comprises an upright light emitting element and an upright light receiving element for detecting a ribbon end indicating member provided adjacent to the end portion of the ribbon to be fed through between the elements, the light emitting element being inserted into one of the perforations and the light receiving element into the other.

8. A ribbon cartridge as claimed in claim 1, in which the detection opening comprises two perforations which are separated by a webbing which is part of the casing, the second guide means being constructed to feed the ribbon across one of the perforations along the predetermined path.

9. A ribbon cartridge as claimed in claim 1, in which each of the first and second rollers comprises two flanges at opposite ends which are tapered toward each other.

10. A ribbon cartridge as claimed in claim 1, in which the casing comprises an upper portion and a lower portion.

11. A ribbon cartridge as claimed in claim 10, in which an inner surface of the upper case comprises a concavity for accommodating the tension supply means.

12. A ribbon cartridge as claimed in claim 5, in which the casing comprises an upper portion and a lower portion, the perforations being formed in the lower portion and separated by the webbing constituted by a part of the lower portion.

13. A ribbon cartridge as claimed in claim 1, in which the casing comprises an upper portion and a lower portion, the upper portion being provided with ribbon end indicator means.

14. A ribbon cartridge as claimed in claim 13, in which the ribbon end indicator means comprises an elongated window which is perforated through the upper portion.

15. A ribbon cartridge as claimed in claim 14, in which an inner surface of the lower portion opposing the window is painted in a color which is contrastive to a color of the ribbon.

16. A ribbon cartridge as claimed in claim 14, in which the window is provided with graduations.

17. A ribbon cartridge as claimed in claim 1, in which the ribbon includes an electrically conductive thin member and a transparent thin member which are additionally provided adjacent to the tail end of the ribbon which is adhered to a core of the supply reel.

* * * * *